US009404506B2

(12) United States Patent
Masutani

(10) Patent No.: US 9,404,506 B2
(45) Date of Patent: Aug. 2, 2016

(54) IMPELLER AND ROTARY MACHINE

(75) Inventor: Jo Masutani, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 632 days.

(21) Appl. No.: 13/262,929

(22) PCT Filed: Feb. 18, 2010

(86) PCT No.: PCT/JP2010/001050

§ 371 (c)(1),
(2), (4) Date: Oct. 5, 2011

(87) PCT Pub. No.: WO2011/007466

PCT Pub. Date: Jan. 20, 2011

(65) Prior Publication Data

US 2012/0027599 A1 Feb. 2, 2012

(30) Foreign Application Priority Data

Jul. 13, 2009 (JP) ..... 2009-164782

(51) Int. Cl.
*F04D 29/30* (2006.01)
*F04D 29/28* (2006.01)

(52) U.S. Cl.
CPC ..... *F04D 29/30* (2013.01); *F04D 29/286* (2013.01)

(58) Field of Classification Search
CPC ..... F04D 29/24; F04D 29/242; F04D 29/286; F04D 29/30
USPC ..... 416/179, 182, 185, 223 R, 228, 235, 416/236 R
See application file for complete search history.

(56) References Cited

U.S. PATENT DOCUMENTS 1,959,710 A * 5/1934 Durdin, Jr. ..... 415/198.1
2,918,254 A * 12/1959 Hausammann ..... F01D 5/021 415/116
5,215,439 A * 6/1993 Jansen et al. ..... 416/183
6,712,912 B2 3/2004 Richards et al.

(Continued)

FOREIGN PATENT DOCUMENTS

CN 100406746 7/2008
JP 58119998 A * 7/1983

(Continued)

OTHER PUBLICATIONS

Yokoyama et al., Mixed Flow Turbine or Radial Turbine, Translation of specification of WO2008062566A1, May 29, 2008.*

(Continued)

*Primary Examiner* — Dwayne J White
*Assistant Examiner* — Danielle M Christensen
(74) *Attorney, Agent, or Firm* — Wenderoth, Lind & Ponack, L.L.P.

(57) ABSTRACT

An impeller of a rotary machine, in which the direction of flow changes from an axial direction to a radial direction as it goes from the inside in the radial direction of a fluid flow passage to the outside in the radial direction thereof, includes a hub surface constituting at least a portion of the fluid flow passage. The impeller also includes a blade surface constituting at least a portion of the fluid flow passage, and a bulge that bulges toward the inside of the fluid flow passage at a corner where a pressure surface, which configures the blade surface, comes in contact with the hub surface in the vicinity of an inlet of the fluid flow passage.

7 Claims, 8 Drawing Sheets

(56) References Cited

U.S. PATENT DOCUMENTS

| | | | | |
|---|---|---|---|---|
| 2005/0047915 | A1 | 3/2005 | Jarrah | |
| 2010/0098548 | A1 * | 4/2010 | Yokoyama et al. ..... | 416/223 R |

FOREIGN PATENT DOCUMENTS

| | | |
|---|---|---|
| JP | 2-33499 | 2/1990 |
| JP | 5-312187 | 11/1993 |
| JP | 2000-136797 | 5/2000 |
| JP | 2001-263295 | 9/2001 |
| JP | 2003-013895 | 1/2003 |
| JP | 2003-336599 | 11/2003 |
| JP | 2005-163640 | 6/2005 |
| JP | 2005-180372 | 7/2005 |
| JP | 2006-002689 | 1/2006 |
| JP | 2007-247494 | 9/2007 |
| KR | 2003-0033881 | 5/2003 |
| WO | WO 2008062566 A1 * | 5/2008 |

OTHER PUBLICATIONS

Chinese Office Action, with English translation, issued Jul. 2, 2013 in Chinese Patent Application No. 201080015580.1.

International Search Report issued May 25, 2010 in International (PCT) Application No. PCT/JP2010/001050.

Written Opinion of the International Searching Authority issued May 25, 2010 in International (PCT) Application No. PCT/JP2010/001050.

Extended European Search Report issued Apr. 9, 2015 in corresponding European Application No. 10799530.0.

* cited by examiner

IMPELLER AND ROTARY MACHINE

TECHNICAL FIELD

The present invention relates to an impeller and a rotary machine, and particularly, to a flow passage shape thereof.

Priority is claimed on Japanese Patent Application No. 2009-164782 filed on Jul. 13, 2009, the contents of which are incorporated herein by reference.

BACKGROUND ART

In centrifugal or mixed-flow compressors used for rotary machines, such as an industrial compressor, a turbo refrigerator, and a small gas turbine, improvements in performance are required, and particularly, improvements in the performance of the impeller that is a key component of the compressors are required. Thus, in recent years, in order to improve the performance of an impeller, an impeller in which a recess is provided at a leading edge between tip and hub of the blades to effectively suppress secondary flow or flaking has been proposed (for example, refer to PTL 1).

Additionally, there are impellers (for example, refer to PTLs 2 and 3) in which turbulence is caused in a flow along the hub surface by forming a plurality of grooves in the hub surface between blades such that a boundary layer of the flow along the hub surface is not expanded, in order to improve the performance of a centrifugal or mixed-flow impeller, and in which a plurality of small blades is provided between blades in order to prevent local concentration of a boundary layer.

RELATED ART DOCUMENT

Patent Literature

[PTL 1] JP-A-2006-2689
[PTL 2] JP-A-2005-163640
[PTL 3] JP-A-2005-180372

SUMMARY OF INVENTION

Technical Problem

FIG. 9 shows the vicinity of a leading edge of a blade in a related-art impeller. As shown in FIG. 9, in an inlet hub surface of a related-art impeller, in order to maintain a throut area at an inlet 206 of a fluid flow passage 210, a blade angle of a blade 203 at an inlet 206 is designed so as to approach to a radial direction of the impeller relative to an entry angle (entry flow angle) of fluid to inlet 206 at a designed flow rate. Therefore, the entry flow angle (hereinafter called entry angle θ) of the fluid with respect to the blade angle becomes large. Since the entry angle θ of the 4444 fluid tends to increase depending on decreases in the inflow, a boudary layer notably grows on the hub surface near a suction surface n of the blade, where the flow rate is lowest in the vicinity of the inlet 206, due to decreases in the inflow. Thus, problems arise in that the efficiency is decreased and the fluid stall.

The invention has been made in view of the above circumstances, and the object thereof is to provide an impeller and a rotary machine that can suppress a decrease in efficiency and a stall of the fluid by growing of a boundary layer on the hub surface near a suction surface n at the inlet when inflow decreases.

Solution to Problem

The invention adopts the following configurations in order to solve the above problems to achieve the object concerned.

An impeller (for example, the impeller 1 in the embodiment) related to the invention is an impeller of a rotary machine in which the direction of flow gradually changes from an axial direction to a radial direction as it goes from the inside in the radial direction of a fluid flow passage (for example, the impeller flow passage 10 in the embodiment) to the outside in the radial direction thereof. The impeller includes a hub surface (for example, the hub surface 4 in the embodiment) constituting at least a portion of the fluid flow passage; a blade surface (for example, the pressure surface p or the suction surface n in the embodiment) constituting at least a portion of the fluid flow passage; and a bulge (for example, the bulge b in the embodiment) that bulges toward the inside of the fluid flow passage at a corner (for example, the corner 12 in the embodiment) where a pressure surface of the blade surface comes in contact with the hub surface in the vicinity of an inlet (for example, the inlet 6 in the embodiment) of the fluid flow passage.

According to the impeller of the rotary machine related to the invention, since the bulge is provided at the corner where the hub surface comes in contact with the pressure surface in the vicinity of the inlet, the leading edge of the blade on the hub surface side is thickly formed and a radius of a round portion, which is formed of the bulge at the leading edge of the blade, becomes large substantively. Therefore, even when the entry angle of the fluid with respect to the blade angle becomes large because the inflow velocity on the hub surface is low, the fluid flows along the round portion, which is formed of the bulge at the leading edge of the blade and increases radius thereof, at a slow pace. Thus, since enlarging a boundary layer at the leading edge in the suction surface side is suppressed, growing the boundary layer on the hub surface near suction surface can be suppressed. Moreover, since the bulge is provided at the corner near the hub surface (that is, local only), and the amount of decrease in the throat area can be minimally suppressed.

Additionally, the strength of the portion contacting the blade with the hub, where a force by the fluid applies to and centrifugal stress is generated by rotating the impeller, can be increased by providing a bulge at the corner in the vicinity of the inlet. Moreover, an increase in the number of parts can be suppressed by being formed integrally with the hub and the blade.

In the impeller of the rotary machine of the above invention, the impeller may further include a second bulge that bulges toward the inside of the fluid flow passage at a corner where a suction surface of the blade comes in contact with the hub surface in the vicinity of the inlet of the fluid flow passage.

In this case, since the second bulge is provided at the corner where the suction surface of the blade comes in contact with the hub surface in addition to the bulge that is provided at the corner where the pressure surface of the blade surface comes in contact with the hub surface, the thickness of the leading edge of the blade near the hub surface can be larger. Therefore, it is possible to further suppress growing of a boundary layer due to decreases in the flow rate, and the strength of the portion contacting the blade with the hub in the vicinity of the inlet can be further increased.

Advantageous Effects of Invention

According to the impeller of the rotary machine related to the invention, even when the entry angle of the fluid with respect to the blade angle becomes large when the flow rate is low, enlarging a boundary layer at the inlet (in particular, on the hub surface near the suction surface) can be suppressed, depending on the increase in the radius of the leading edge of the blade, by providing the bulge thereon. Therefore, there is an advantage that a decrease in the efficiency of the low flow rate and the stall of the fluid can be suppressed.

DESCRIPTION OF EMBODIMENTS

Figure 1:
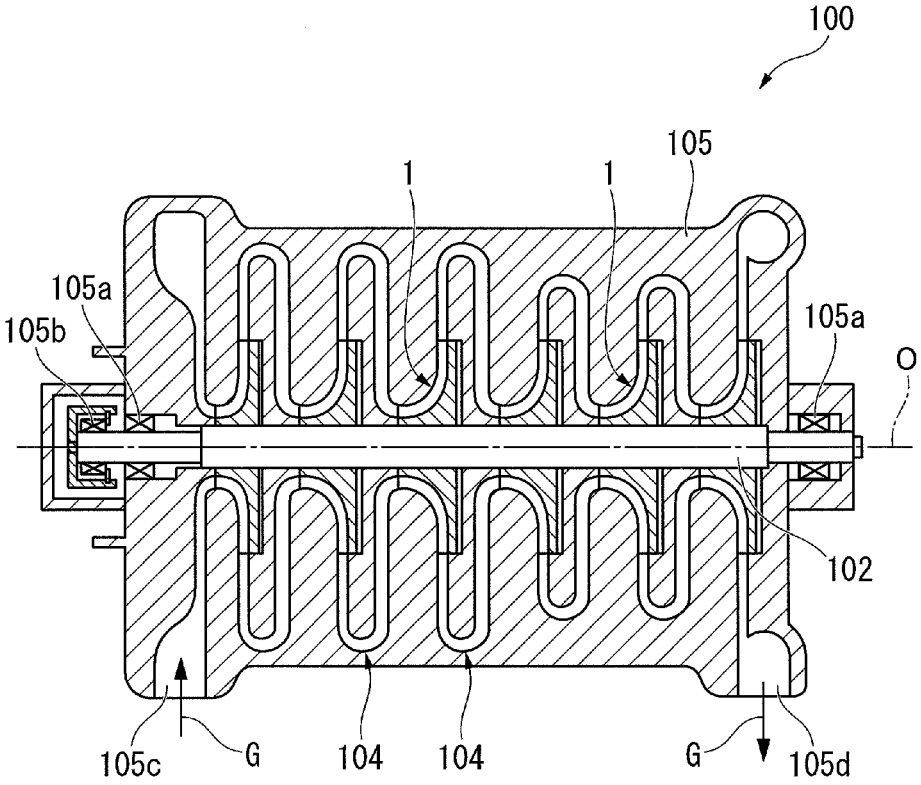
FIG. 1 is a cross-sectional view of a centrifugal compressor in the embodiment of the invention.

Next, an impeller and a rotary machine in the embodiment of the invention will be described, referring to the drawings. The impeller of this embodiment will be described taking an impeller of a centrifugal compressor that is a rotary machine as an example.

A centrifugal compressor 100 that is a rotary machine of the present embodiment, as shown in FIG. 1, is mainly constituted by, as an example, a shaft 102 that is rotated around an axis O, an impeller 1 that is attached to the shaft 102 and compresses process gas (gas) G using a centrifugal force, and a casing 105 that rotatably supports the shaft 102 and is formed with a flow passage 104 that allows the process gas G to pass from the upstream to the downstream.

A casing 105 is formed so as to form a substantially columnar outline, and the shaft 102 is arranged so as to pass through a center. Journal bearings 105*a* are provided at both ends of the shaft 102 in an axial direction, and a thrust bearing 105*b* is provided at one end. The journal bearings 105*a* and the thrust bearing 105*b* rotatably support the shaft 102. That is, the shaft 102 is supported by the casing 105 via the journal bearings 105*a* and the thrust bearing 105*b*.

Additionally, a suction port 105*c* into which the process gas G is made to flow from the outside is provided on the side of one end of the casing 105 in the axial direction, and a discharge port 105*d* through which the process gas G flows to the outside is provided on the side of the other end. An internal space, which communicates with the suction port 105*c* and the discharge port 105*d*, respectively, and repeats diameter enlargement and diameter reduction, is provided in the casing 105. This internal space functions as a space that accommodates the impeller 1, and also functions as the above flow passage 104.

That is, the suction port 105*c* and the discharge port 105*d* communicate with each other via the impeller 1 and the flow passage 104.

A plurality of the impellers 1 is arranged at intervals in the axial direction of the shaft 102. In addition, although six impellers 1 are provided in the illustrated example, it is only necessary that at least one or more impellers are provided.

Figure 2:
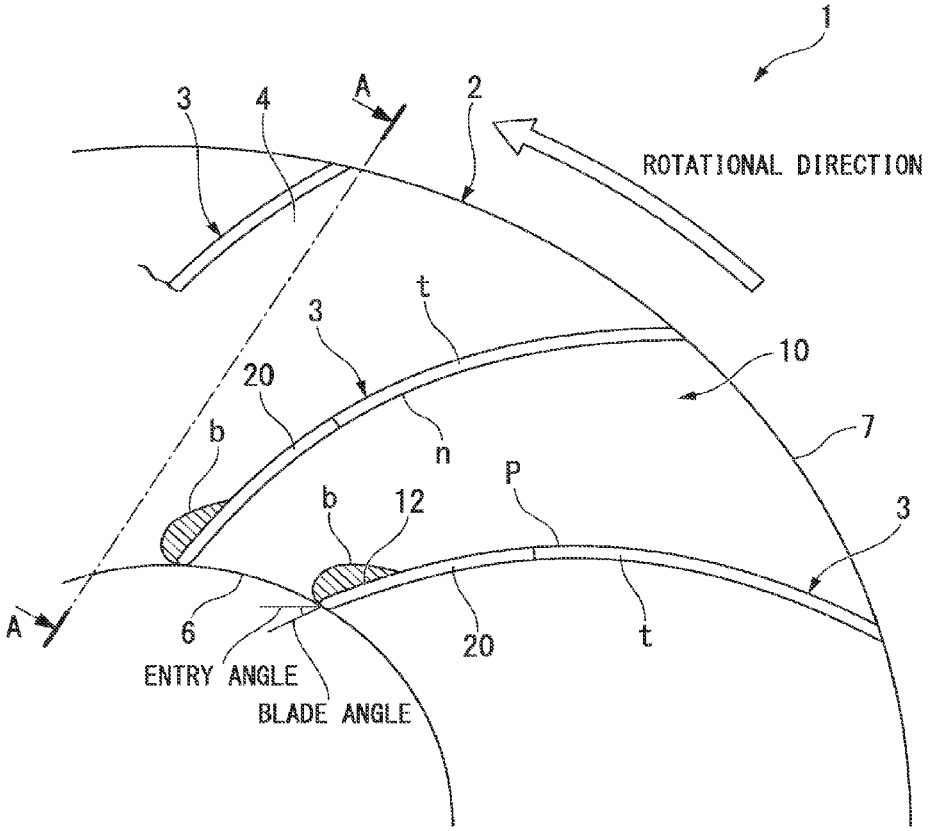
FIG. 2 is an enlarged front view showing chief parts of the impeller in the embodiment of the invention.
Figure 3:
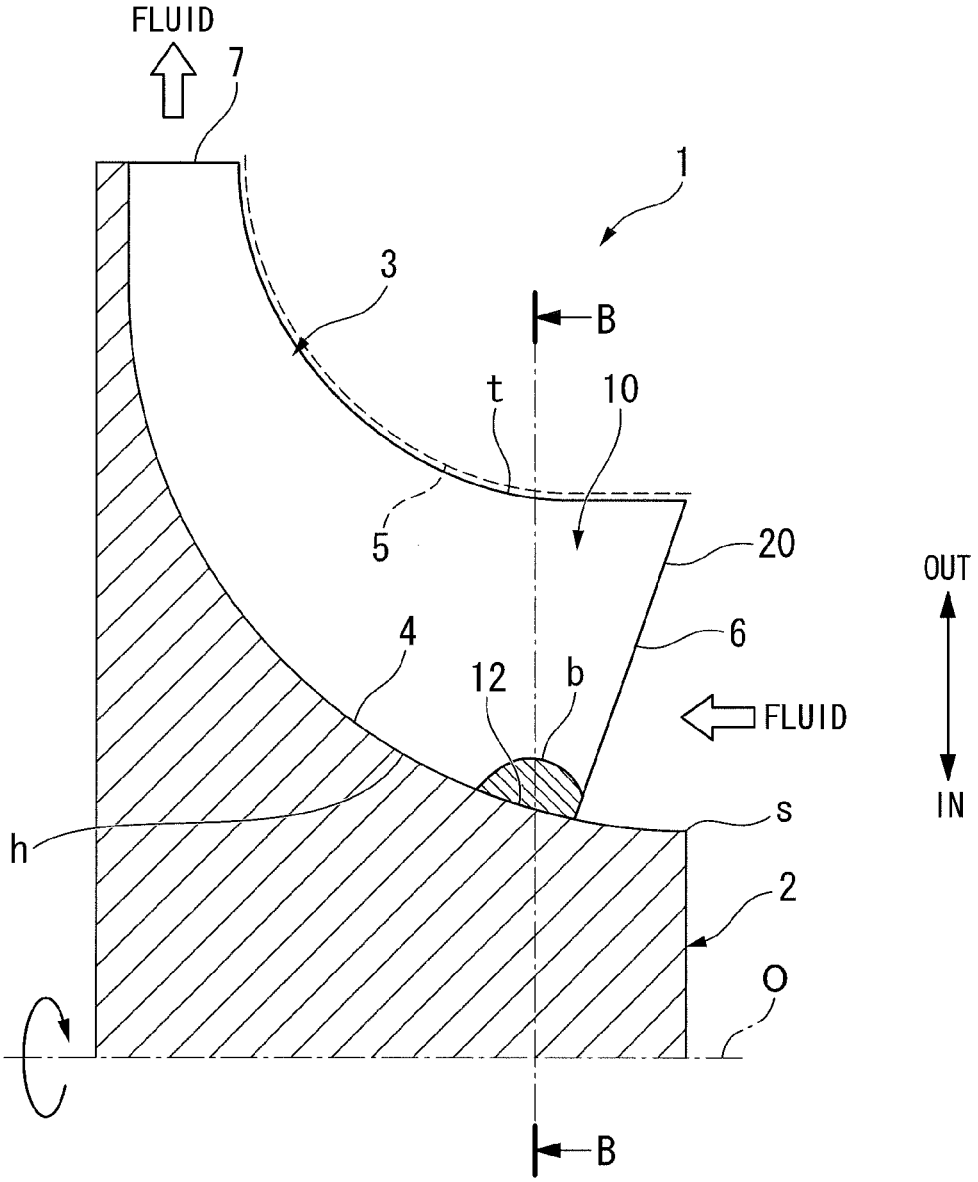
FIG. 3 is a sectional view taken along a line A-A of FIG. 2.

FIGS. 2 to 3 show the impeller 1 of the centrifugal compressor 100, and the impeller 1 includes a hub 2 and a plurality of blades 3.

The hub 2 is formed in a substantially round shape in front view, and is made rotatable around the axis with the axis O as a center. In the hub 2, as shown in FIG. 3, a hub surface 4 is formed so as to be curved toward the outside in the radial direction from a predetermined position S on the inside in the radial direction slightly separated radially outward from the axis O. This curvedly formed hub surface 4 is formed such that a surface located on the inside in the radial direction is formed along the axis O, and runs along the radial direction gradually as it goes to the outside in the radial direction. That is, the hub 2 is formed such that the axial thickness thereof decreases from one (upstream) of the axial end surfaces as it goes to the outside in the radial direction from the position S on the inside in the radial direction slightly separated from the axis O, and this axial thickness becomes larger near the inside and becomes smaller near the outside. In addition, in FIG. 3, an arrow indicates the radial direction of the hub 2.

Figure 4:
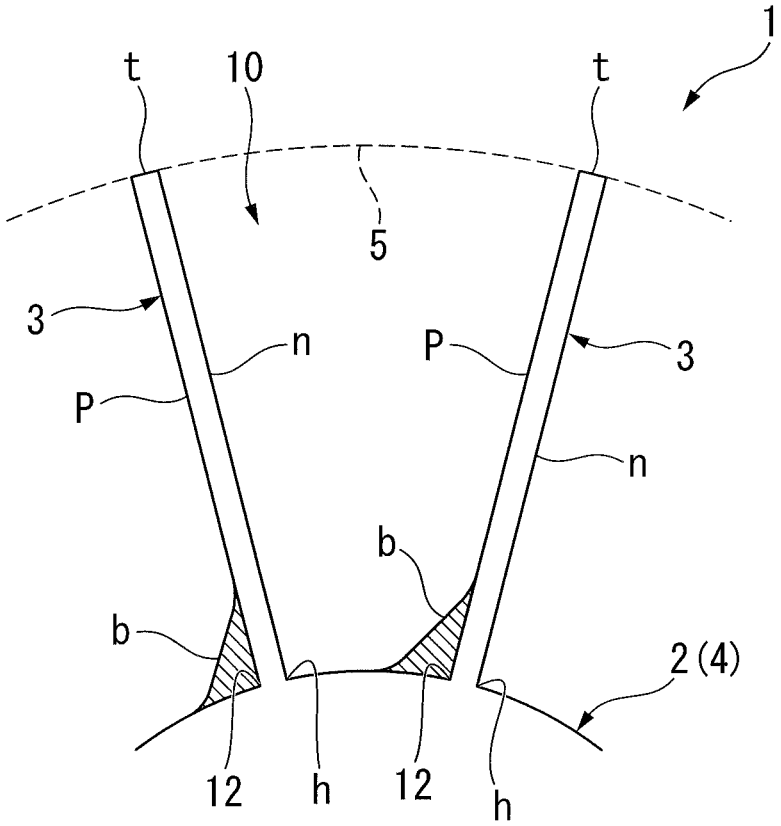
FIG. 4 is a sectional view along a line B-B of FIG. 3.

A plurality of blades 3 is substantially radially arranged on the above-described hub surface 4 as shown in FIG. 2, and is erected substantially perpendicularly (in normal direction) to the hub surface 4 as shown in FIG. 4. The blade 3 is formed such that the thickness thereof is substantially uniform from a hub end h up to a tip end t, and shows a curved shape that slightly becomes a convex surface toward the rotational direction (shown by an arrow in FIG. 2) of the hub 2 from the hub end h (refer to FIG. 3) to the tip end t. As the impeller 1 rotates, a blade surface on a convex side of respective blade surfaces on a convex side and the convex side of the curved blade 3 becomes a pressure surface p, and a blade surface on the concave side that is a back side of the convex surface becomes the suction surface n.

Additionally, as shown in FIG. 3, the tip end t of a blade 3 is formed so as to be curved from the inside in the radial direction of the hub 2 to the outside in the radial direction thereof. More specifically, similarly to the above-described hub surface 4, the blade is formed in a concave shape that runs along the axis O nearer the inside in the radial direction and runs along the radial direction gradually as it goes to the outside in the radial direction.

If the hub surface 4 is taken as a reference, the blade 3 is formed so as to be higher near the inside in the radial direction of the hub 2 and lower near the outside in the radial direction thereof.

In the above-described impeller 1, the tip end t side of the blade 3 is covered with the casing 105 (refer to FIG. 1), and an impeller flow passage 10 of the impeller 1 is constituted by a shroud surface 5 constituted by the casing 105, the pressure surface p and suction surface n of adjacent blades 3 described above, and the hub surface 4 between the pressure surface p and the suction surface n. As the impeller 1 rotates, a fluid flows in along the radial direction from an inlet 6 of the impeller flow passage 10 located on the inside in the radial direction of the hub 2, and the fluid flows out to the outside along the radial direction from an outlet 7 located on the outside in the radial direction due to a centrifugal force.

The impeller flow passage 10 having the configuration described above is formed so as to be curved from the above-described inlet 6 toward the outlet 7, and the direction of flow of the flow passage gradually changes from the axial direction to the radial direction as it goes from the inside in the radial direction of the hub 2 to the outside in the radial direction thereof.

A bulge b that bulges toward the inside of the impeller flow passage 10 is formed at a corner 12 where the hub surface 4 comes in contact with the pressure surface p of the blade 3 in the vicinity of an inlet 6. The bulge b is formed integrally with the hub surface 4 and the pressure surface p (refer to FIGS. 2 to 4). In addition, a cross-sectional shape of the leading edge 20 of the blade 3 is formed in a substantially semicircular shape (refer to FIG. 5). The bulge b is formed at the corner 12 in the vicinity of the inlet 6 in the above-described corner 12 (that is, a part of the corner 12 nearby the leading edge 20).

Figure 5:
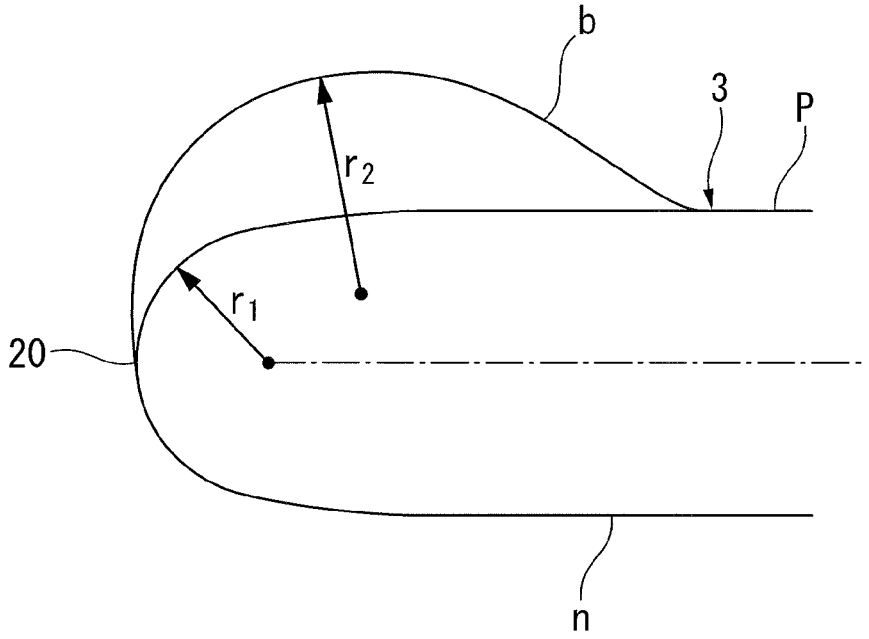
FIG. 5 is an enlarged cross-sectional view showing leading edge of a blade in the embodiment of the invention.

The maximum width of the bulge b, is set to about 20% of the width of the impeller flow passage 10, and to about 20% of the height of the blade 3. The bulge b has a maximum width and a maximum height at a position where the bulge b smoothly bulges as it goes along a flow direction from a vicinity of the inlet 6 to downstream in a curved surface protruding toward the inside of the impeller flow passage 10. The bulge b gradually decreases in the curved surface same as the above from the position having the maximum width and the maximum height, and smoothly connects to the hub surface 4 and the pressure surface p at a position of about 10% of the flow passage length from the inlet 6 to the outlet 7 of the impeller flow passage 10. The thickness of the leading edge 20 of the blade 3 near the hub surface 4 is increased by forming the bulge b in this manner, and the radius r1 of the leading edge of the blade practically increases to the radius r2 of the leading edge of the blade as shown in FIG. 5.

Figure 6:
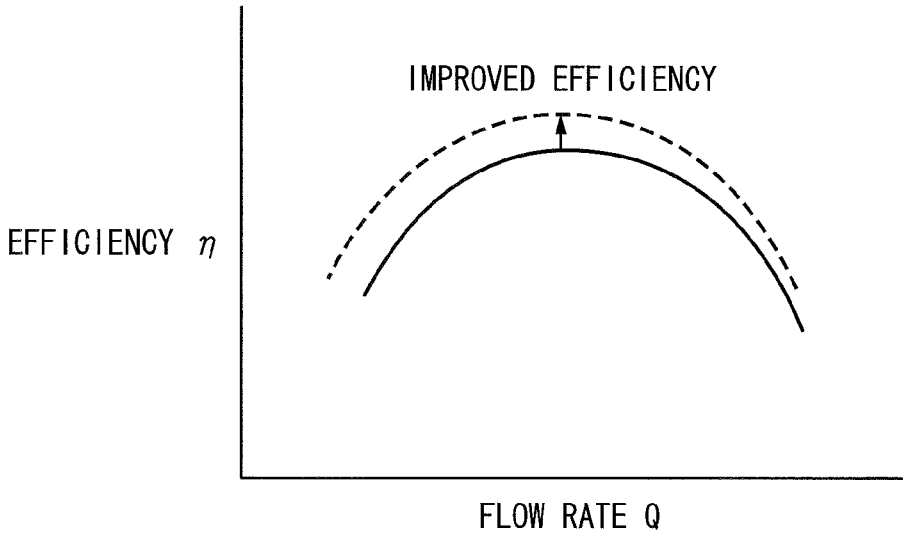
FIG. 6 is a graph showing efficiency characteristics with respect to the flow rate of the impeller in the embodiment of the invention.

FIG. 6 is a graph showing the efficiency characteristics of rotary machines using the impeller 1 and a related-art impeller. In this graph, the vertical axis represents efficiency $\eta$, and the horizontal axis represents flow rate Q. In addition, in FIG. 6, a solid line shows the efficiency of a rotary machine including an impeller that is not provided with the bulge b, and a broken line shows the efficiency of a rotary machine including the above-described impeller 1 that is provided with the bulge b.

As shown in FIG. 6, it is apparent that the efficiency is improved in a case where the bulge b is provided at the same flow rate Q, as compared to a case where the bulge b is not provided. Particularly, it is apparent that the efficiency on the side of a small flow rate is improved greatly.

Figure 7:
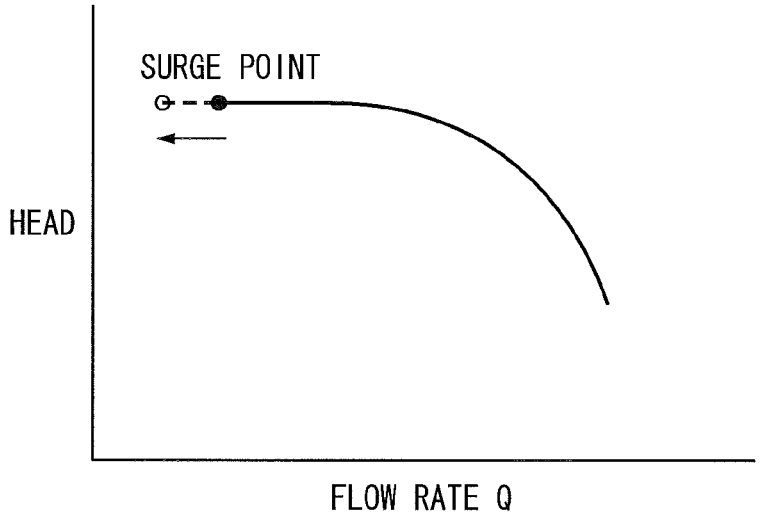
FIG. 7 is graph showing head characteristics with respect to the flow rate of the impeller in the embodiment of the invention.

Additionally, FIG. 7 is a graph showing the head (work) characteristics of the rotary machines using the impeller 1 and the related-art impeller, and the vertical axis represents head (work), and the horizontal axis represents the flow rate Q. In addition, in FIG. 7, a solid line shows the head of a rotary machine including an impeller that is not provided with the bulge b, and a broken line shows the head of a rotary machine including the above-described impeller 1 that is provided with the bulge b.

As shown in FIG. 7, it is apparent that a surge point (shown by an open circle in the drawing) of the rotary machine including the above-described impeller 1 that is provided with the bulge b is displaced toward a lower flow rate side more than a surge point of the rotary machine including the impeller that is not provided with the bulge b (shown by a filled circle in the drawing), and a surge margin is expanded.

As shown in these FIGS. 6 and 7, the reason why the efficiency characteristics of the impeller 1 is improved and the surge point is displaced toward a lower flow rate side in comparison with the impeller without the bulge b is that it is difficult to grow a boundary layer on the suction surface n by partial increasing of the radius of the leading edge of the blade at the inlet 6 in a case where the entry angle of the fluid as shown in FIG. 2 becomes large when a flow rate is low. In addition, the surge point is a minimum flow rate at which a rotary machine is required to operate normally without surging.

Accordingly, according to the impeller 1 of the rotary machine of the above-described embodiment, the thickness of the leading edge 20 of the blade 3 near the hub surface 4 is partially increased by providing the bulge b at the corner 12 where the hub surface 4 comes in contact with the pressure surface p in the vicinity of the inlet 6. Therefore, the radius r1 of the leading edge of the blade near the hub surface 4 practically increases to the radius r2 of the leading edge of the blade, and growing of a boundary layer on the suction surface near the hub at a designed flow rate can be suppressed.

In addition, since the radius r1 of the leading edge of the blade practically increases to the radius r2 of the leading edge of the blade by forming the leading edge 20 of the blade 3 near the hub surface 4 to be thick with the bulge b, even when the entry angle of the fluid with respect to the blade angle (refer to FIG. 2) becomes large, enlarging a boundary layer on the hub surface 4 near the suction surface n can be suppressed. Thus, suppressing a decrease in the efficiency at low flow rate and preventing from the stall of the fluid can be achieved, and the surge margin can be expanded.

Moreover, since the bulge b is provided at the corner 12 near the hub surface 4 (that is, local only), amount of decrease in the throat area at the inlet 6 of the impellar flow passage 10 can be minimally suppressed.

Additionally, the strength of the portion contacting the blade 3 with the hub 2, where a force by the fluid applies to and centrifugal stress is generated by high-speed rotating the impeller 1, can be increased by providing the bulge b at the corner 12 in the vicinity of the inlet 6. Moreover, an increase in the number of parts can be suppressed by being formed integrally with the hub 2 and the blade 3.

Figure 8:
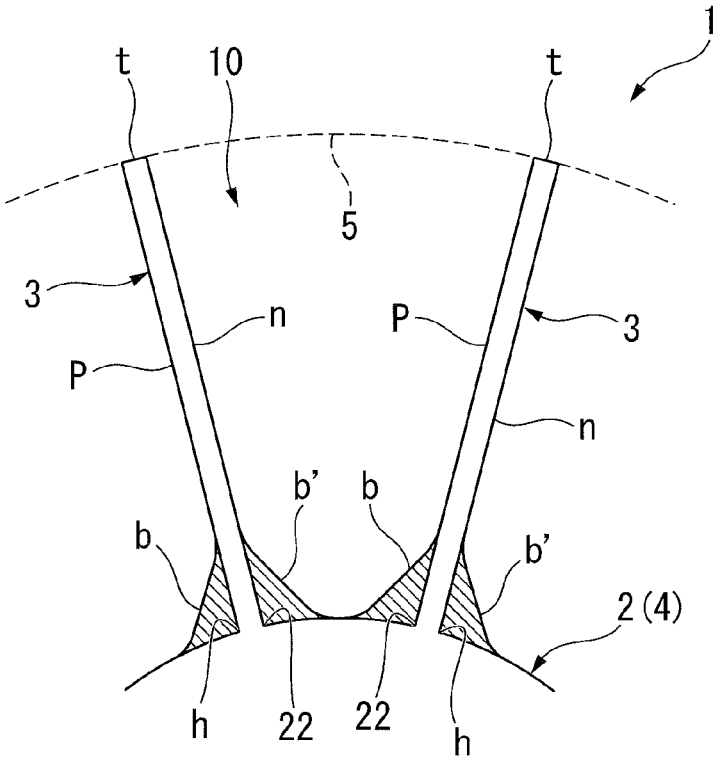
FIG. 8 is a cross-sectional view equivalent to FIG. 4 in another example of the embodiment of the invention.
Figure 9:
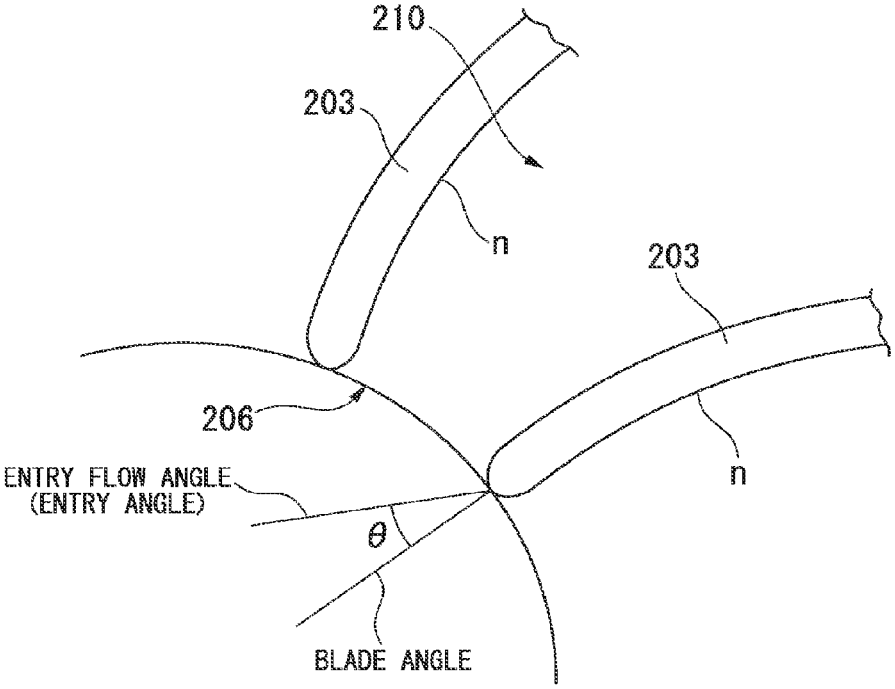
FIG. 9 is a front view showing vicinity of a leading edge of a blade in a related-art impeller.

In addition, in the impeller 1 of the above-described embodiment, the case where the bulge b is provided at the corner 12 where the pressure surface p comes in contact with the hub surface 4 has been described in the vicinity of an inlet 6 of the fluid flow passage 10; however, the invention is not limited to this configuration. For example, as another example, as shown in FIG. 8, the bulge b' may be provided at the corner 22 where the suction surface n comes in contact with the hub surface 4 in the vicinity of an inlet 6 of the fluid flow passage 10. In a case where the bulge b' is provided at the corner 22 in this manner, since the thickness of the leading edge 20 of the blade 3 near the hub surface 4 can be larger, the radius of the leading edge of the blade can further become large. Therefore, it is possible to further suppress growing of a boundary layer due to decreases in the flow rate. Moreover, the strength of the portion contacting the blade 3 with the hub 2 at the corner 12 in the vicinity of the inlet 6 can be further increased.

Additionally, the shape and position of the bulge b of the above-described embodiment are examples, and shape and position are not limited thereto.

Additionally, although the impeller of the centrifugal rotary machine has been described in the above embodiment, the impeller is not limited to this, and may be an impeller of a mixed-flow rotary machine. Additionally, the invention may be applied to an impeller of a blower, a turbine, or the like without being limited to the compressor. Additionally, although the so-called open impeller in which the facing side of the hub surface 4 is covered with the shroud surface 5 has been described as an example in the above-described embodiment, the invention may be applied to a closed impeller including a wall that covers the tip end t side integrally formed in the blade 3. In the case of this closed type impeller, it is only necessary to substitute the shroud surface 5 of the above-described embodiment with the inner surface side of the wall that covers the tip end t. In addition, as in the related art, a fillet R formed by the tip roundness of a cutting cutter tool is slightly given to a boundary portion between the hub surface 4 other than the bulge b, and a blade surface (the suction surface n or the pressure surface p).

INDUSTRIAL APPLICABILITY

According to the impeller of the rotary machine related to the invention, even when the entry angle of the fluid with respect to the blade angle becomes large when the flow rate is low, enlarging a boundary layer at the inlet (in particular, on the hub surface near the suction surface) can be suppressed, depending on the increase in the radius of the leading edge of the blade, by providing the bulge thereon. Therefore, there is an advantage that a decrease in the efficiency of the low flow rate and the stall of the fluid can be suppressed.

REFERENCE SIGNS LIST

1: IMPELLER
4: HUB SURFACE
6: INLET
7: OUTLET
10: IMPELLER FLOW PASSAGE (FLUID FLOW PASSAGE)
12: CORNER
22: CORNER
100: CENTRIFUGAL COMPRESSOR
p: PRESSURE SURFACE (BLADE SURFACE)
n: SUCTION SURFACE (BLADE SURFACE)
b: BULGE
b': BULGE (SECOND BULGE)

The invention claimed is:

1. An impeller of a compressor, in which a direction of flow changes from an axial direction to a radial direction from an inlet in the radial direction of a fluid flow passage to an outlet in the radial direction thereof, the impeller comprising:

a hub surface constituting at least a portion of the fluid flow passage;

a blade surface constituting at least a portion of the fluid flow passage;

a bulge that is formed at a corner where a pressure surface, which configures the blade surface, comes in contact with the hub surface in the vicinity of the inlet of the fluid flow passage; and a second bulge that bulges toward an inside of the fluid flow passage at a corner where a suction surface of a blade comes in contact with the hub surface in the vicinity of the inlet of the fluid flow passage, wherein the bulge has a curved surface smoothly protruding from a leading edge of the blade toward the inside of the fluid flow passage, the bulge having a width and a height that gradually decrease in a downstream direction of the fluid flow passage, and the bulge has a curved surface smoothly protruding from the corner where the pressure surface comes in contact with the hub surface toward the inside of the fluid flow passage, the width of the bulge gradually decreasing as extending outward in the radial direction of the fluid flow passage, and the height of the bulge gradually decreasing in the axial direction.

2. A compressor comprising the impeller according to claim 1.

3. The impeller according to claim 1, wherein the leading edge of the blade has a rounded surface.

4. The impeller according to claim 3, wherein the bulge smoothly bulges along the flow direction from an apex of the rounded surface of the leading edge of the blade towards downstream.

5. The impeller according to claim 3, wherein the rounded surface is a convex surface.

6. The impeller according to claim 5, wherein the bulge smoothly bulges along the flow direction from an apex of the convex surface of the leading edge of the blade towards downstream.

7. The impeller according to claim 1, wherein the bulge smoothly bulges along a portion of the leading edge of the blade.

* * * * *